US006025826A

United States Patent [19]

Hung et al.

[11] Patent Number: 6,025,826

[45] Date of Patent: Feb. 15, 2000

[54] METHOD AND APPARATUS FOR HANDLING ALPHA PREMULTIPLICATION OF IMAGE DATA

[75] Inventors: Jeannette Hung, Redwood City; Jerald R. Evans, Mountain View; James Graham, Sunnyvale, all of Calif.

[73] Assignee: Sun Microsystems, Inc., Palo Alto, Calif.

[21] Appl. No.: 08/885,619

[22] Filed: Jun. 30, 1997

[51] Int. Cl.[7] ..... G09G 5/00

[52] U.S. Cl. ..... 345/112; 345/501; 707/103

[58] Field of Search ..... 345/150, 153, 345/501, 151, 428, 443, 118, 438, 439, 112; 341/87; 348/459, 671, 678, 263, 248, 269; 358/518, 523, 500; 703/103

[56] References Cited

U.S. PATENT DOCUMENTS

| | | | |
|---|---|---|---|
| 4,647,963 | 3/1987 | Johnson et al. | 358/518 |
| 5,079,720 | 1/1992 | Sinclair | 345/443 |
| 5,132,786 | 7/1992 | Ishiwata | 358/500 |
| 5,184,124 | 2/1993 | Molpus et al. | 341/87 |
| 5,485,203 | 1/1996 | Nakamura et al. | 348/263 |
| 5,537,563 | 7/1996 | Guttag et al. | 348/459 |
| 5,557,691 | 9/1996 | Izata | 345/428 |
| 5,592,196 | 1/1997 | Nakamatsu et al. | 345/150 |
| 5,740,343 | 4/1998 | Tarolli et al. | 345/501 |

*Primary Examiner*—Dennis-Doon Chow
*Attorney, Agent, or Firm*—Hecker & Harriman

[57] ABSTRACT

A method and apparatus for handling alpha premultiplication is described. In an embodiment, image data is contained within an instance of an image object that also contains a state variable indicating whether the image data is currently premultiplied or non-premultiplied. A method within the image object responds to requests to coerce the image data into a desired or destination premultiplication state. Based on the value of the state variable, the method multiplies or divides the image data components by the alpha component, or does nothing. The state variable is updated to reflect any change in the premultiplication state of the image data. In one embodiment, the image object is implemented as a buffered image object instance containing a tile object instance and a color model object instance. The tile object instance maintains a reference to a data array(s) containing the image data file, and provides methods for inserting and extracting pixel data from the data array(s). The color model object instance contains the premultiplication state variable for the image data, and a method for coercing the image data into a desired premultiplication state. Applications can insure that image data is in the desired premultiplication state by accessing the associated buffered image object instance to invoke the coercion method, and specifying the desired state. The buffered image object instance responds by invoking the data coercion method in the color model object instance, and specifying the desired premultiplication state and the tile object instance containing the image data.

10 Claims, 6 Drawing Sheets

```
int tileData[ ] [ ];                                  // x,y tile data array of pixel values
int width, height;                                    // width and height of tile data array
boolean isAlphaPremultiplied;                         // alpha premultiplied state of tile data

public ColorModel coerceData(boolean desiredAlphaState) {
   int alpha, red, green, blue, pixel[ ];
   ColorModel cmB;
   if (isAlphaPremultiplied != desiredAlphaState) {   // if true, need to coerce data
      for (int x=0; x<width; x++) {                   // for each column of tile data
         for (int y=0; y<height; y++) {               // for each row of tile data
            pixel=getData(x, y, tileData);            // get data for current pixel
            alpha=pixel[3];                           // extract alpha component
            red=pixel[2];                             // extract red component
            green=pixel[1];                           // extract green component
            blue=pixel[0];                            // extract blue component

            if (desiredAlphaState) {                  // if true, multiply by alpha
               pixel[2]=red*alpha,                    // insert multiplied red component
               pixel[1]=green*alpha;                  // insert multiplied green component
               pixel[0]=blue*alpha;                   // insert multiplied blue component
            }
            else {                                    // if false, divide by alpha
               pixel[2]=red/alpha;                    //insert divided red component
               pixel[1]=green/alpha;                  // insert divided green component
               pixel[0]=blue/alpha;                   // insert divided blue component
            }
            putData(x, y  pixel, tileData);           // replace modified pixel data

      }
      cmB=copyColorModel(desiredAlphaState);          // create ColorModel copy
      return cmB;                                     // return new ColorModel
   }
   return this;                                       // return current ColorModel
}
```

FIG. 4A

```
boolean isAlphaPremultiplied;                    // alpha premultiplied state of tile data

public ColorModel coerceData(Tile tile, boolean desiredAlphaState) {
  int alpha, red, green, blue, pixel[ ];
  ColorModel cmB;
  if (isAlphaPremultiplied != desiredAlphaState) {        // if true, need to coerce data
    int width=tile.getWidth();                            // get width from tile instance
    int height=tile.getHeight();                          // get height from tile instance
    for (int x=0; x<width; x++) {                         // for each column of tile data
      for (int y=0; y<height; y++) {                      // for each row of tile data
        pixel=tile.getData(x, y);          // get data for current pixel from tile instance
        alpha=pixel[3];                                   // extract alpha component
        red=pixel[2];                                     // extract red component
        green=pixel[1];                                   // extract green component
        blue=pixel[0];                                    // extract blue component

        if (desiredAlphaState) {                          // if true, multiply by alpha
          pixel[2]=red*alpha;                             // insert divided red component
          pixel[1]=green*alpha;                           // insert divided green component
          pixel[0]=blue*alpha;                            // insert divided blue component
        }
        else {                                            // if false, divide by alpha
          pixel[2]=red/alpha;                             //insert multiplied red component
          pixel[1]=green/alpha;                           // insert multiplied green component
          pixel[0]=blue/alpha;                            // insert multiplied blue component
        }
        tile.putData(x, y, pixel);         // replace modified pixel data in tile instance
      }
    }
    cmB=copyColorModel(desiredAlphaState);                // create ColorModel copy
    return cmB;                                           // return new ColorModel
  }
  return this;                                            // return current ColorModel
}
```

FIG. 4B

METHOD AND APPARATUS FOR HANDLING ALPHA PREMULTIPLICATION OF IMAGE DATA

BACKGROUND OF THE INVENTION

1. Field of the Invention

This invention relates to the field of object-oriented computer applications, and, more specifically, to object-oriented image processing applications.

2. Background Art

In the field of computer graphics, images are typically represented as a row-column array of pixels stored as image data within an image file. The image data corresponding to each pixel indicates the color value associated with that pixel. Often, these color values are comprised of individual components, such as the red, green and blue components of an RGB image, all of which contribute to the color of the associated pixel. Each component is considered a separate "channel" of an image. For example, all red components of an RGB image are considered elements of the red channel.

Other visual aspects may also be associated with pixels by placing corresponding data in a separate channel of an image. One commonly used image channel is the alpha channel, which contains information about pixel transparency for use in the mixing of images. When the alpha channel is used, each pixel, in addition to other components, includes an alpha component value. This alpha value is used to scale each of the other components of the respective pixel to factor the transparency value into the pixel, such as for use in compositing images. Compositing digital images using the alpha channel is further described in the paper by T. Porter and T. Duff entitled, "Compositing Digital Images," SIGGRAPH 1984, in *Computer Graphics*, Vol. 18, No. 3, pp. 253–259.

In some processing applications, the pixel components are stored in a premultiplied state, i.e. prescaled by alpha, whereas in other applications, the pixel components are not premultiplied. Unfortunately, it is not always possible to insure that a given image file is of the appropriate state for a given application.

The value for alpha varies in the range of zero to one (typically encoded as zero to $(2^n-1)$, where n is the number of bits representing alpha) with zero being completely transparent and one being completely opaque. Values in between are considered translucent. The alpha value is used to modify the values of the color components in a pixel such that, when processed, the RGB values for each pixel are multiplied by alpha, i.e., the non-premultiplied ARGB data ($\alpha$, R, G, B) of pixel x,y yields RGB data ($\alpha$R, $\alpha$G, $\alpha$B). Premultiplied data is stored in the form ($\alpha$, $\alpha$R, $\alpha$G, $\alpha$B). An example of non-premultiplied data and premultiplied data, given eight-bit component precision ($\alpha$:0–1.0; R, G, B:0–255), $\alpha$=0.25, R=100, G=10 and B=132, is:

| Non-Premultiplied ($\alpha$, R, G, B) (0.25, 100, 10, 130) | Premultiplied ($\alpha$, $\alpha$R, $\alpha$G, $\alpha$B) (0.25, 25, 2.5, 32.5) |
|---|---|
| L = 01000000 | $\alpha$= 01000000 |
| R = 01100100 | $\alpha$R = 00011001 |
| G = 00001010 | $\alpha$G = 00000011 |
| B = 10000010 | $\alpha$B = 00100001 |

An advantage of premultiplied data is that multiplication by alpha is not necessary in image processing steps that utilize the alpha value. The multiplication has been done beforehand, reducing the processor time needed to process an image. The time savings are proportional to the number of components in each pixel, and the number of pixels in the image. Some images are therefore stored in the premultiplied state to exploit this time saving advantage.

A disadvantage of using premultiplied data is that multiplication by a can cause color information to be lost. Specifically, color resolution may be lost due to the finite bit precision of the component values and the rounding (or truncating) effect of binary multiplication. In the above example, premultiplication of the green and blue component values yields $\alpha$G=2.5 and $\alpha$B=32.5, which are rounded to $\alpha$G=3 and $\alpha$B=33, respectively. If the actual unmultiplied green and blue values were needed, for instance in precise color comparison or thresholding operations, the premultiplied values would be divided by alpha to yield G'=12 and B'=132, rather than the actual G=10 and B=130, Thus, resolution errors would occur that could affect processing. The resolution error increases for smaller $\alpha$, and may effectively drive small component values to zero. Some images are therefore stored in a non-premultiplied state to avoid the resolution problems of premultiplied data.

Most applications or application methods are written to process image data received in one state, the premultiplied state or the non-premultiplied state. However, with the proliferation of countless images and image formats across networks, or distributed via CD-ROM, there is no mechanism for insuring that the premultiplication state of a given image file matches that expected by a processing application, barring special handling by the application.

In the prior art, Kodak's FlashPix™ image format (FlashPix Format Specification, Version 1.0, ©1996 Eastman Kodak Company) identifies premultiplied or non-premultiplied image data by providing a bit within the image file that indicates the premultiplication state. This approach requires parsing of the image data file to locate and interpret the corresponding bit. No mechanism exists for associating a premultiplication state with other image data file formats. Further, FlashPix does not itself insure that the state of the image data matches that expected by an application. Beyond file format issues, existing general purpose graphics and imaging APIs do not support handling different alpha premultiplication states for images.

SUMMARY OF THE INVENTION

A method and apparatus for handling alpha premultiplication is described. In an embodiment of the present invention, image data is contained within an instance of an image object. The image object instance also contains a state variable indicating whether the image data is currently premultiplied or non-premultiplied. A method within the image object responds to requests to coerce the image data into a desired or destination premultiplication state. Based on the value of the state variable, the method multiplies the image data components by the alpha component, divides the image data components by the alpha component, or does nothing. The state variable is updated to reflect any change in the premultiplication state of the image data.

In one embodiment of the invention, the image object is implemented as a buffered image object instance containing a tile object instance and a color model object instance. The tile object instance maintains a reference to a data array containing the image data, and provides methods for inserting and extracting pixel data from the data array. The color model object instance contains the premultiplication state variable for the image data, and a method for coercing the image data into a desired premultiplication state depending on the current value of the premultiplication state variable. The color model object instance also contains methods for obtaining component data such as RGB data from pixel data pursuant to a given color model or color space definition.

Applications can insure that image data is in the desired premultiplication state by accessing the associated buffered image object instance to invoke the coercion method in the buffered image object instance, and specifying the desired state. The buffered image object instance responds by invoking the data coercion method in the color model object instance, and specifying the desired premultiplication state and the tile object instance containing the image data. The color model object instance's coercion method modifies the data as needed, and updates the premultiplication state variable.

With an embodiment of the invention, an image processing operator is allowed to take source input images in arbitrary premultiplication states and produce destination output images in arbitrary premultiplication states, independent of the premultiplication state(s) required by the operator.

BRIEF DESCRIPTION OF THE DRAWINGS

FIG. 4A is an embodiment of a program code method in a ColorModel object for coercing image data into a premultiplied or non-premultiplied state, wherein said image data is accessed directly by the ColorModel object.

FIG. 4B is an embodiment of a program code method in a ColorModel object for coercing image data into a premultiplied or non-premultiplied state, wherein said image data is accessed via a separate Tile object.

DETAILED DESCRIPTION OF THE INVENTION

Figure 1:
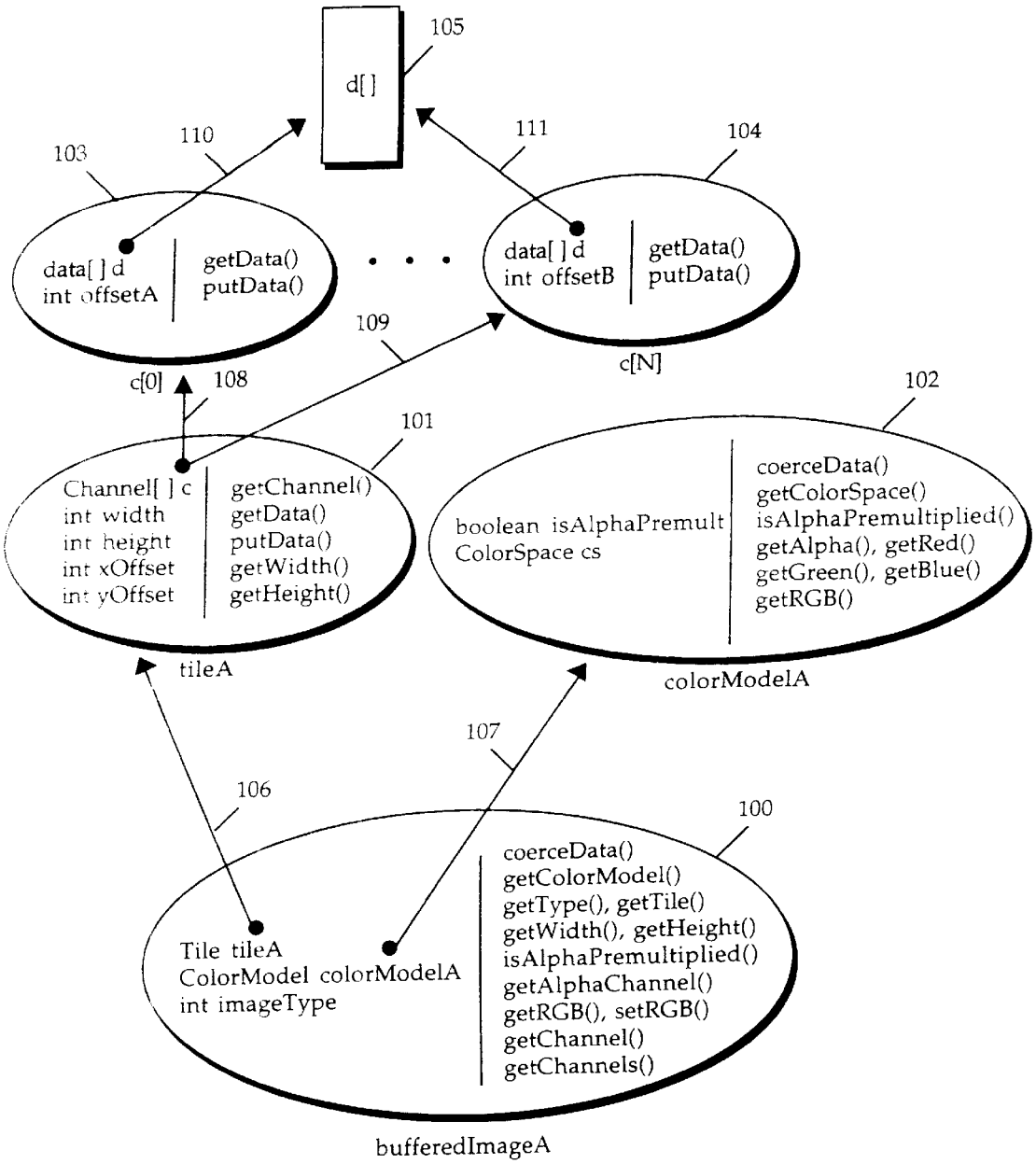
FIG. 1 is a block diagram of object relationships within one embodiment of an image object.

The invention is a method and apparatus for handling alpha premultiplication of image data. In the following description, numerous specific details are set forth to provide a more thorough description of embodiments of the invention. It will be apparent, however, to one skilled in the art, that the invention may be practiced without these specific details. In other instances, well known features have not been described in detail so as not to obscure the invention.

An embodiment of the invention utilizes object-oriented programming techniques to create a BufferedImage class, a Tile class and a ColorModel class. Each instance of the BufferedImage class contains an instance of the ColorModel class and the Tile class. The Tile class contains a reference to a data array, and methods for accessing image data within the data array. In a further embodiment, the Tile class contains an array of channel objects that contain references to one or more data arrays. The ColorModel class contains color model and color space definitions and a premultiplication state variable. The ColorModel class also contains methods for interpreting data components according to the color model definition, and a method for coercing data to assume a desired premultiplication state. The BufferedImage class contains a public data coercion method which invokes the data coercion method of the associated ColorModel object. For a better understanding of object classes, a brief description of object-oriented programming is provided below.

Object-Oriented Programming

Object-oriented programming is a method of creating computer programs by combining certain fundamental building blocks, and creating relationships among and between the building blocks. The building blocks in object-oriented programming systems are called "objects." An object is a programming unit that groups together a data structure (instance variables) and the operations (methods) that can use or affect that data. Thus, an object consists of data and one or more operations or procedures that can be performed on that data. The joining of data and operations into a unitary building block is called "encapsulation."

An object can be instructed to perform one of its methods when it receives a "message." A message is a command or instruction to the object to execute a certain method. It consists of a method selection (name) and a plurality of arguments that are sent to an object. A message tells the receiving object what operations to perform.

One advantage of object-oriented programming is the way in which methods are invoked. When a message is sent to an object, it is not necessary for the message to instruct the object how to perform a certain method. It is only necessary to request that the object execute the method. This greatly simplifies program development.

Object-oriented programming languages are predominantly based on a "class" scheme. The class-based object-oriented programming scheme is generally described in Lieberman, "Using Prototypical Objects to Implement Shared Behavior in Object-Oriented Systems," OOPSLA 86 Proceedings, September 1986, pp. 214–223, A class defines a type of object that typically includes both instance variables and methods for the class. An object class is used to create a particular instance of an object. An instance of an object class includes the variables and methods defined for the class. Multiple instances of the same class can be created from an object class. Each instance that is created from the object class is said to be of the same type or class.

A hierarchy of classes can be defined such that an object class definition has one or more subclasses. A subclass inherits its parent's (and grandparent's etc.) definition. Each subclass in the hierarchy may add to or modify the behavior specified by its parent class.

To illustrate, an employee object class can include "name" and "salary" instance variables and a "set_salary" method. Instances of the employee object class can be created, or instantiated for each employee in an organization. Each object instance is said to be of type "employee." Each employee object instance includes the "name" and "salary" instance variables and the "set_salary" method. The values associated with the "name" and "salary" variables in each employee object instance contain the name and salary of an employee in the organization. A message can be sent to an employee's employee object instance to invoke the "set_salary" method to modify the employee's salary (i.e., the value associated with the "salary" variable in the employee's employee object).

An object is a generic term that is used in the object-oriented programming environment to refer to a module that contains related code and variables. A software program can be written using an object-oriented programming language whereby the program's functionality is implemented using objects.

BufferedImage, Tile and ColorModel Object Embodiments

In an embodiment of the invention, an object-oriented programming language such as Java, C++, etc. is used to generate BufferedImage, Tile and ColorModel classes. A Channel class may also be utilized to encapsulate specific data access parameters and methods otherwise incorporated in the Tile class. Instances of these classes are used to construct an apparatus for implementing the invention. The general class definitions are provided below.

The Tile class comprises instance variables specifying the "width" and "height" of the image tile (i.e., the size of the image data pixel array in terms of x and y); instance variables (xOffset and yOffset) specifying tile offset values in terms of x and y for those tiles that are part of a larger image; and a reference ("d") to the image data array or to further objects (e.g., array of Channel objects "c[ ]") for accessing the image data array. The methods of the Tile class comprise getwidth() and getHeight() methods which return the width and height values for a tile instance; getData() and putData() methods which read and write pixel values from the image data for a specified x, y location; and, if the Channel class is used, a getChannel() method which returns a specified Channel instance.

Getdata() and putData() methods are provided in the Tile class which act upon a designated pixel by inputting or outputting a single component of the pixel or all components of the pixel. The arguments for the getData() and putData() methods either specify an integer data variable and an integer channel number for single component access, or an integer array of data variables to access all components of a pixel. In some applications, each pixel may be treated as only a single component. For example, all ARGB values may be packed into a single integer pixel component, or a pixel may consist of a single color index component. GetData() and putData() methods may also be provided for block access to the image data (i.e., the transfer of multiple pixels) by specifying a starting pixel location and the width and height of the pixel block. However, for clarity, examples and figures will refer to single pixel access methods.

A Channel class may be used to encapsulate some of the specific data access functionality of the Tile class. The Channel class contains a reference to a data array holding the image data for a particular storage band, and layout parameters describing the band of datum or channel elements within the image (such as all "R" values for a RGB image). These layout parameters may include bit precision and bit or word offset values for a specific storage band of data. The Channel class also contains methods for reading the stored layout parameters from an instance of the Channel class, and methods for inputting and outputting data from the desired storage band using the specified layout parameters.

To read a channel element from a data array, a message is sent to an instance of a Channel object, invoking the getData() method. The message specifies a particular pixel in an image using x and y parameters as arguments. The desired data or channel element is returned from the instance of the Channel object in an appropriate form, e.g., as an integer. Similarly, channel elements are written into the appropriate storage band of an image by sending a message to the instance of the Channel object and invoking the putData() method. The arguments of the message specify the x and y parameters of the particular pixel, as well as the data to be placed in the given position.

The ColorModel class comprises a Boolean instance variable indicating a premultiplication state. It defines how to interpret a collection of image data to determine individual components such as R, G and B values. The ColorModel may include lookup tables for indexed color values, color space transforms, pixel component bit-masks, etc. The ColorModel class thus provides a mechanism for translating the pixel storage band data (for one or more storage bands) into ARGB, RGB or other defined color space representations via masking, transforming or lookup tables.

The methods of the ColorModel class comprise a coerceData() method, which accepts a reference to a tile instance and a desired premultiplication state, and returns an updated ColorModel instance. The coerceData() method will be more fully discussed below. The getColorSpace() method returns the color space object which provides colorimetric information for an instance of ColorModel. The isAlphaPremultiplied() method returns the value of the premultiplication state variable. The getAlpha(), getRed(), getgreen(), and getBlue() methods provide a mechanism for extracting the respective component from a pixel. The getRed(), getGreen and getBlue() methods provide non-premultiplied R, G and B values, dividing by alpha as needed. The getRGB() method returns the non-premultiplied RGB value for a given pixel. Though, for purposes of example, particular methods are described with respect to the RGB color space, similar methods for other types of color space, such as CMYK, may also be provided (e.g., getCyan(), getCMYK(), etc.).

The BufferedImage class contains an instance of the Tile class and an instance of the ColorModel class. An integer instance variable contains a value indicating the image type (e.g., 32-bit ARGB, etc.) for a given instance of BufferedImage. Methods of the BufferedImage class comprise a coerceData() method which receives a desired premultiplication state and invokes the coerceData method of the ColorModel instance. GetColorModel(), getType(), and getTile() are methods which return the ColorModel instance, image type, and Tile instance associated with an instance of the BufferedImage class. GetWidth() and getHeight() return the associated parameters of the Tile instance, and isAlphaPremultiplied() returns the state value stored in the ColorModel instance. GetChannel() returns the specified channel instance from the Tile instance, and getChannels() returns all channel instances from the Tile instance. GetAlphaChannel() returns the alpha channel from the Tile instance. GetRGB() and setRGB(), at a specified location in the image data array, return and set, respectively, an integer pixel value represented in the RGB color space. Other types of color space may be used as well.

In one embodiment, the Tile, ColorModel, BufferedImage and Channel classes are used to create an apparatus as illustrated in FIG. 1. The objects in FIG. 1 are shown with instance variables listed on the left side of the object and methods listed on the right side. In FIG. 1, an instance of the BufferedImage class, bufferedImageA 100, contains a reference to instance tileA of the Tile class for managing the raw image data, and a reference to instance colorModelA of the ColorModel class for defining the raw image data in terms of a color space and maintaining other characteristics of the raw image data such as premultiplication state. An integer instance variable specifies the image type of bufferedImageA 100, A library of methods are provided in bufferedImageA 100 for interacting with the Tile and ColorModel instances.

The instance colorModelA referenced within bufferedImageA 100 is shown as object 102, coupled to buffered- ImageA 100 by arrow 107, The instance variables of colorModelA 102 comprise a reference to an instance of a ColorSpace class and a Boolean representation of the premultiplication state of the image data associated with Tile instance tileA. A library of methods are provided in colorModelA 102 for acting upon pixel data according to the color space or color model definition. One of the methods is the coerceData() method for forcing the image data in a given tile into a desired premultiplication state.

The instance tileA referenced in bufferedImageA 100 is shown as object 101, coupled to bufferedImageA 100 by arrow 106, The instance variables of tileA 101 comprise the width and height values, and x and y offsets associated with a set of image data. Instances of the Channel class are represented as channel array "c" in tileA 101, The channel array provides the mechanism by which the data array(s) containing the image data is (are) accessed. A library of methods are provided in tileA for accessing data via the channel array and for reading the parameters of the tile image data.

The channel array "c" within tileA 101 refers to instances c[0] 103 through c[N] 104, coupled to tileA 101 via arrows 108 and 109, respectively. Channel instance 103 comprises a reference "d" to data array 105 containing the image data for bufferedImageA 100, The reference is represented in the figure by arrow 110, Channel layout parameters define the location of respective channel elements in data array 105, GetData() and putData() methods are provided for accessing data array 105 to interact with a given channel element referenced by pixel (x, y). Channel instance 104 also comprises a reference "d" (represented by arrow 111) to data array 105, and channel layout parameters defining the location of another set of channel elements within the data array. Channel instance 104 contains the same methods as Channel instance 103, The Channel instances c[0] through c[N] may all reference the same data array d[ ], or the Channel instances may reference several different arrays, depending on how image data is structured in memory.

It will be obvious that object classes comprising other object class instances may incorporate all parameters and methods embedded within the internal objects. For example, all methods and parameters associated with the Channel class may be incorporated into the Tile class. Instances of the Tile class would then access the tile data array directly, rather than through instances of the Channel class.

Figure 2:
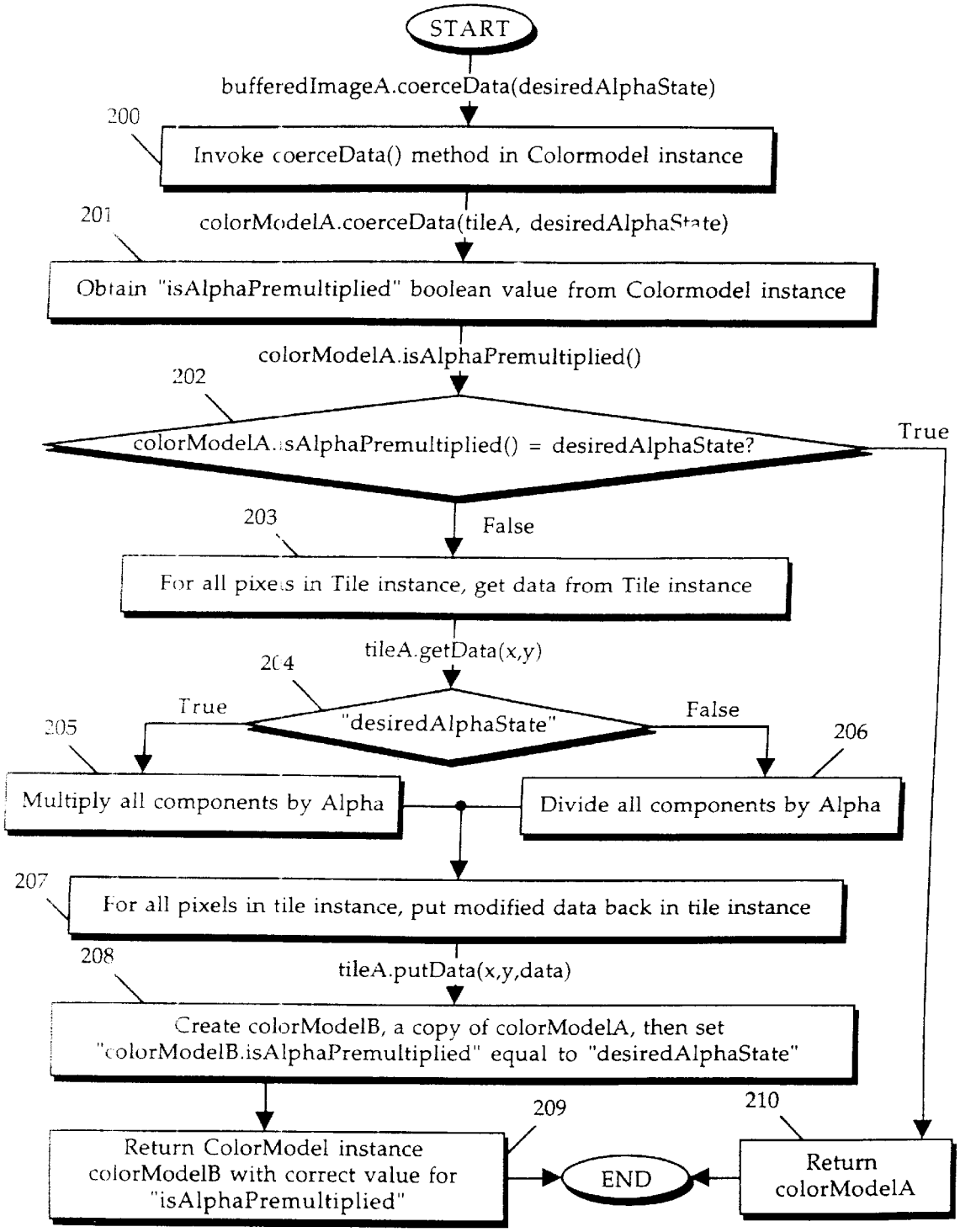
FIG. 2 is a flow diagram of an embodiment of a process for coercing image data into a premultiplied or non-premultiplied state.

The process by which the apparatus of FIG. 1 insures a desired premultiplication state is illustrated in the flow diagram of FIG. 2. The process is typically initiated by an invocation of the coerceData() method of bufferedImageA, specifying the desired premultiplication state. This may be accomplished by an application sending a message to bufferedImageA with a Boolean argument. In step 200, the coerceData() method of the ColorModel instance is invoked via a message specifying a Tile instance and the desired premultiplication state. The ColorModel instance responds in step 201 by accessing the isAlphaPremultiplied boolean state variable within the ColorModel instance, such as by invoking the isAlphaPremultiplied() method.

In step 202, the value of the isAlphaPremultiplied state variable is compared with the desired premultiplication state specified in the coerceData() invocation. If the isAlphaPremultiplied value matches the desired premultiplication state, then no action is taken to change the image data. However, if the isAlphaPremultiplied value does not match the desired premultiplication state, the process continues to step 203 in which pixel values are read from the image data. The pixels may be read by invoking the getData() method of the Tile instance and cycling through each pixel location, for example.

In step 204, a decision is made regarding the modification needed to force the data to conform to the desired premultiplication state. If the desired state is true, indicating premultiplication, the process continues to block 205 where all pixel components are multiplied by alpha. If, however, the desired state is false, indicating non-premultiplication, the process continues to step 206 where all pixel components are divided by alpha.

If the pixel storage band elements (channel elements) do not directly correspond to color space components, the application of alpha in steps 205 and 206 may include operations other than strict multiplication or division, depending upon the relationship between the actual color space and the storage elements. Table lookups, shifting, masking, etc. may be performed as well. Also, in some color spaces, not all components are affected by alpha. For example, in the HSV (hue, saturation, value) color space, only the "value" component is affected. As such, only the value component is multiplied or divided by alpha. In the alternative, pixel components may be transformed into the RGB color space for multiplication or division by alpha, and then be transformed back into the original color space.

After steps 205 and 206, the pixel data is written back to the image data array in the Tile instance in step 207, for example, by invoking the putData() method of the Tile instance. Though this example modifies the image data and places the modified image data back into the referenced source image data array, a new destination data array may also be created to store the modified data. In step 208, a new ColorModel instance, colorModelB, is created as a copy of colorModelA. Then, the isAlphaPremultiplied state variable of colorModelB is assigned the value of the desired premultiplication state. Finally, in step 209, ColorModelA returns colorModelB, with the updated state variable, to the invoking entity.

Figure 3:
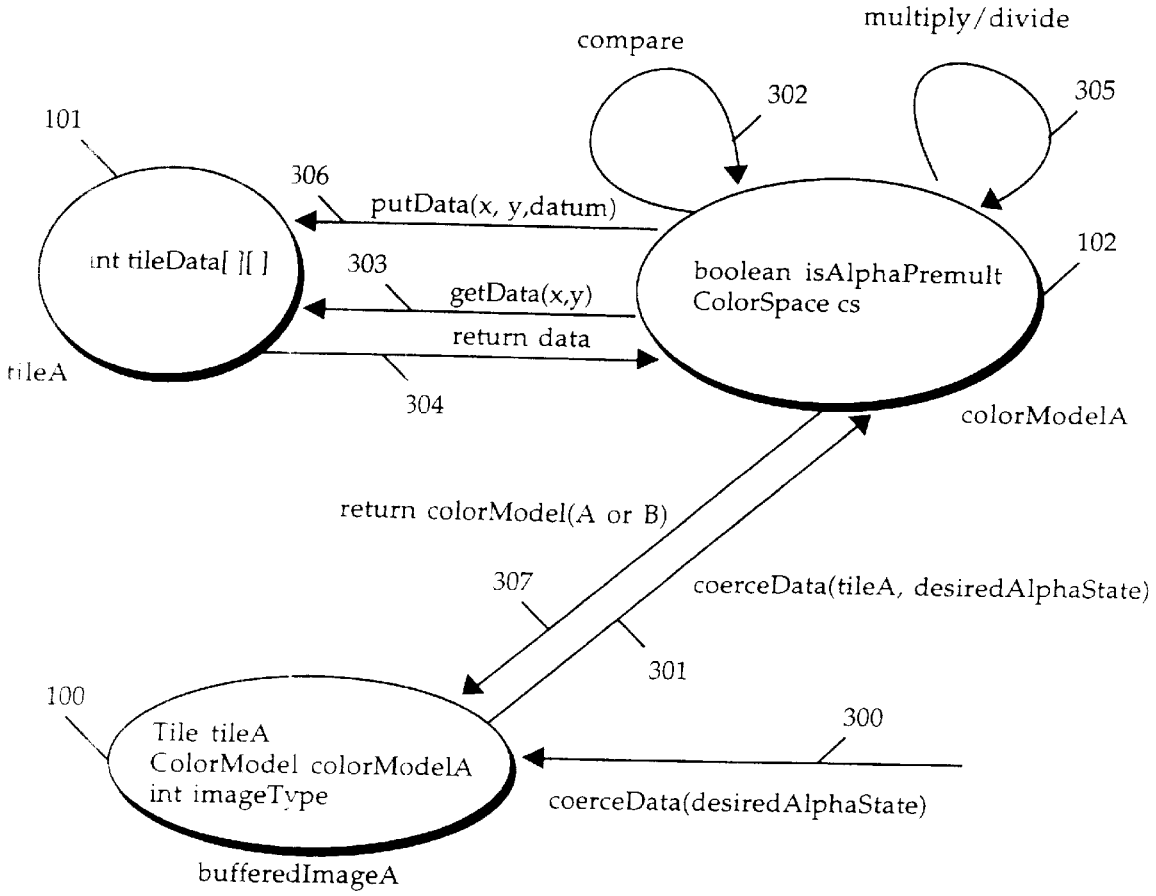
FIG. 3 is a block diagram of an image object apparatus illustrating an embodiment of a process for coercing data into a premultiplied or non-premultiplied state.

FIG. 3 is a block diagram illustrating the object interaction of a data coercion process in one embodiment of the invention. In the embodiment of FIG. 3, the image data is stored in a row-column integer data array, "tileData," and is referenced in Tile instance tileA 101, The data array is accessed on a pixel-wise basis using getData() and putData() methods and x and y parameters. Objects 100, 101 and 102 correspond to the similarly referenced objects of FIG. 1.

Message 300 is sent to bufferedImageA 100, for instance, from an application that intends to process the image data that is referenced by bufferedImageA 100 via tileA 101, Message 300 invokes the coerceData() method and specifies a Boolean value that represents the desired premultiplication state. The coerceData() method of bufferedImageA 100 sends a message to colorModelA 102, specifying a Tile instance tileA and the Boolean desired premultiplication state value. Message 301 invokes the coerceData() method within colorModelA 102.

The coerceData() method of colorModelA 102 internally compares the Boolean desired premultiplication state value with the current value of the instance variable isAlphaPremultiplied, as represented by arrow 302, If the two values match, colorModelA 102 returns a reference to itself via response 307, and the interaction ends for the data coercion process. If the two values do not match, colorModelA 102 sends message 303 to tileA 101, specifying an x, y pixel location and invoking the getData() method. The getData() method of tileA 101 locates the specified pixel data in the tileData data array and returns the pixel data to colorModelA 102 as response 304, The coerceData() method of colorModelA 102 extracts the alpha value from the returned pixel data and multiplies or divides the other components by alpha, as represented by arrow 305, such that the pixel data conforms to the desired premultiplication state. An external alpha channel (i.e., a channel not contained within the Tile instance) may also be used. The modified pixel data is then placed in message 306, along with the corresponding pixel x, y parameters, and sent to tileA 101, Message 306 invokes the putData() method of tileA 101 which writes the pixel data to the tileData data array.

For each pixel in the tile data array, the actions represented by arrows 303–306 are repeated until all pixels are in the desired premultiplication state. In another embodiment, the actions represented by arrows 303–306 can also be performed wherein the entire data array is operated on at one time. Thus, action 303 is a request for all of the data in the data array which is returned in response 304, The operation represented by arrow 305 operates on each element of the data array and returns the modified data via action 306.

After the data modification (e.g., multiplication or division) is completed, the coerceData() method of colorModelA 102 creates a new instance colorModelB as a copy of colorModelA, sets the instance variable isAlphaPremultiplied of colorModelB to the desired premultiplication state, and returns a reference for colorModelB to bufferedImageA 100 in response 307.

FIGS. 4A and 4B provide program code for two ARGB embodiments of a coerceData() method. The code of FIG. 4A assumes a tileData array directly accessible to the method, such as if a reference to the data array is passed to the ColorModel instance. GetData() and putData() methods are then implemented in the ColorModel instance itself to access the pixel components within the referenced data array. The code of FIG. 4B assumes the tile data is accessible via a separate Tile instance referenced within the method invocation.

In FIG. 4A, an "if" statement is used to determine whether the current value of isAlphaPremultiplied differs from the Boolean value "desiredAlphaState" that is passed with the method invocation, i.e., whether the data needs to be coerced. If the data does not need to be coerced, the current colorModel, "this," is returned to the requester. Within the "if" statement, given that the data does need to be coerced, a primary "for" loop cycles through the columns of the data array. A secondary "for" loop cycles through the rows of the data array.

Within the secondary "for" loop, the pixel at the given row, column location is read using a getData() method. The getData() method of this example provides the pixel data as an array of four integer values: pixel[3]=alpha, pixel[2]=red, pixel[1]=green, and pixel[0]=blue. A second "if" statement is used to determine whether multiplication or division is required. If multiplication is required, each component is multiplied by alpha. Otherwise (else), each component is divided by alpha. Outside of the second "if" statement, but within the secondary "for" loop, a putData() method is used to write the modified components back to the data array. Once the primary and secondary "for" loops have exited, a new colorModel instance is created with the "desiredAlphaState" value. Finally, before the method exits, the new colorModel instance is returned to the requester.

FIG. 4B is similar to FIG. 4A except that the Tile instance is passed to the coerceData() method when the method is invoked. The getData() and putData() methods are invoked from the Tile instance, and the width and height of the data array are obtained from the Tile instance by invoking the getWidth() and getHeight() methods prior to the primary "for" loop.

Embodiment of Computer Execution Environment (Hardware)

Figure 5:
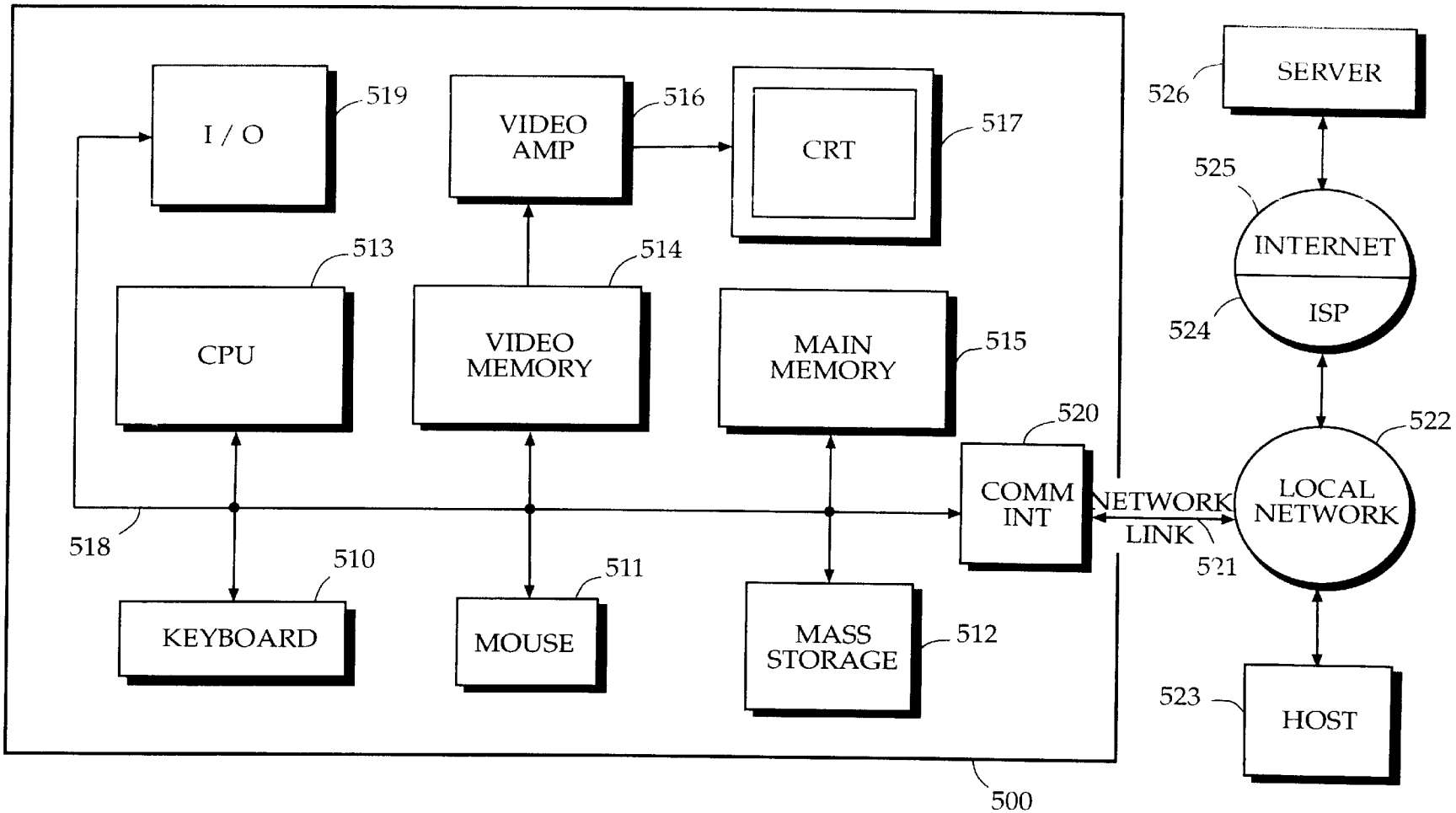
FIG. 5 is a block diagram of an embodiment of a computer system capable of providing a suitable execution environment for an embodiment of the invention.

An embodiment of the invention can be implemented as computer software in the form of computer readable program code executed on a general purpose computer such as computer 500 illustrated in FIG. 5. A keyboard 510 and mouse 511 are coupled to a bi-directional system bus 518. The keyboard and mouse are for introducing user input to the computer system and communicating that user input to central processing unit (CPU) 513. Other suitable input devices may be used in addition to, or in place of, the mouse 511 and keyboard 510, I/O (input/output) unit 519 coupled to bi-directional system bus 518 represents such I/O elements as a printer, A/V (audio/video) I/O, etc.

Computer 500 includes a video memory 514, main memory 515 and mass storage 512, all coupled to bi-directional system bus 518 along with keyboard 510, mouse 511 and CPU 513, The mass storage 512 may include both fixed and removable media, such as magnetic, optical or magnetic optical storage systems or any other available mass storage technology. Bus 518 may contain, for example, thirty-two address lines for addressing video memory 514 or main memory 515, The system bus 518 also includes, for example, a 32-bit data bus for transferring data between and among the components, such as CPU 513, main memory 515, video memory 514 and mass storage 512. Alternatively, multiplex data/address lines may be used instead of separate data and address lines.

In one embodiment of the invention, the CPU 513 is a microprocessor manufactured by Motorola, such as the 680X0 processor or a microprocessor manufactured by Intel, such as the 80X86, or Pentium processor, or a SPARC microprocessor from Sun Microsystems. However, any other suitable microprocessor or microcomputer may be utilized. Main memory 515 is comprised of dynamic random access memory (DRAM). Video memory 514 is a dual-ported video random access memory. One port of the video memory 514 is coupled to video amplifier 516, The video amplifier 516 is used to drive the cathode ray tube (CRT) raster monitor 517, Video amplifier 516 is well known in the art and may be implemented by any suitable apparatus. This circuitry converts pixel data stored in video memory 514 to a raster signal suitable for use by monitor 517, Monitor 517 is a type of monitor suitable for displaying graphic images.

Computer 500 may also include a communication interface 520 coupled to bus 518, Communication interface 520 provides a two-way data communication coupling via a network link 521 to a local network 522. For example, if communication interface 520 is an integrated services digital network (ISDN) card or a modem, communication interface 520 provides a data communication connection to the corresponding type of telephone line, which comprises part of network link 521. If communication interface 520 is a local area network (LAN) card, communication interface 520 provides a data communication connection via network link 521 to a compatible LAN. Wireless links are also possible. In any such implementation, communication interface 520 sends and receives electrical, electromagnetic or optical signals which carry digital data streams representing various types of information.

Network link 521 typically provides data communication through one or more networks to other data devices. For example, network link 521 may provide a connection through local network 522 to host computer 523 or to data equipment operated by an Internet Service Provider (ISP) 524. ISP 524 in turn provides data communication services through the world wide packet data communication network now commonly referred to as the "Internet" 525. Local network 522 and Internet 525 both use electrical, electromagnetic or optical signals which carry digital data streams. The signals through the various networks and the signals on network link 521 and through communication interface 520, which carry the digital data to and from computer 500, are exemplary forms of carrier waves transporting the information.

Computer 500 can send messages and receive data, including program code, through the network(s), network link 521, and communication interface 520. In the Internet example, server 526 might transmit a requested code for an application program through Internet 525, ISP 524, local network 522 and communication interface 520. In accord with the invention, one such downloaded application is the apparatus for handling alpha premultiplication described herein.

The received code may be executed by CPU 513 as it is received, and/or stored in mass storage 512, or other non-volatile storage for later execution. In this manner, computer 500 may obtain application code in the form of a carrier wave.

The computer systems described above are for purposes of example only. An embodiment of the invention may be implemented in any type of computer system or programming or processing environment.

Thus, a method and apparatus for handling alpha premultiplication in image data has been described in conjunction with one or more specific embodiments. The invention is defined by the claims and their full scope of equivalents.

We claim:

1. In an object-oriented computer system, a method of handling alpha premultiplication of image data, said method comprising:

storing at least one data array containing image data;

storing a state variable indicating a current premultiplication state of said image data;

receiving a first method invocation comprising a destination premultiplication state;

executing a data coercion method, wherein said data coercion method comprises:

determining if said current premultiplication state matches said destination premultiplication state; and if said current premultiplication state does not match said destination premultiplication state, modifying said image data to conform to said destination premultiplication state, and setting said current premultiplication state to said destination premultiplication state;

obtaining a first object;

obtaining a second object referenced by said first object, said second object comprising said at least one data array and at least one method that accesses said image data within said at least one data array; and obtaining a third object referenced by said first object, said third object comprising said state variable and said data coercion method.

2. The method of claim 1, further comprising:

in response to receiving said first method invocation, said first object sending a second method invocation to said third object, said second method invocation comprising said destination premultiplication state and a reference to said second object, said second method invocation initiating said execution of said data coercion method.

3. The method of claim 1, wherein said data coercion method further comprises:

invoking a first access method of said second object to get said image data from said at least one data array; and invoking a second access method of said second object to put modified image data into said at least one data array.

4. A computer system comprising:

a processor;

a memory coupled to said processor;

at least one data array within said memory;

image data stored within said at least one data array, said image data comprising at least one pixel;

program code executed by said processor, said program code comprising:

a reference to said at least one data array;

a first method receiving a pixel reference as an argument in a first method invocation, said first method comprising program code configured to cause said processor to get said image data from said at least one data array;

a second method receiving a pixel reference and a data value as arguments in a second method invocation, said second method comprising program code configured to cause said processor to put said data value in said at least one data array;

a state variable indicating a current premultiplication state of said image data;

a data coercion method receiving a destination premultiplication state as an argument in a data coercion method invocation, said data coercion method comprising program code configured to cause said processor to modify said image data to conform to said destination premultiplication state, if said destination premultiplication state does not match said current premultiplication state;

a first object encapsulating said reference to said at least one data array, said first method and said second method;

a second object encapsulating said state variable and said data coercion method; and a third object, said third object comprising:

a reference to said first object;

a reference to said second object; and a third method receiving said destination premultiplication state as an argument in a third method invocation, said third method comprising program code configured to cause said processor to send said data coercion method invocation, said data coercion method invocation further comprising a reference to said first object.

5. A computer program product comprising:

a computer usable medium having computer readable program code embodied therein that handles alpha premultiplication of image data, said computer program product comprising:

computer readable program code configured to cause a computer to store a reference to at least one data array containing image data;

computer readable program code configured to cause a computer to store a state variable containing a current premultiplication state of said image data;

computer readable program code configured to cause a computer to execute a data coercion method in response to a coerce message, said coerce message containing a destination premultiplication state, said computer readable program code configured to cause a computer to execute said data coercion method comprising:

computer readable program code configured to cause a computer to determine if said current premultiplication state matches said destination premultiplication state; and computer readable program code configured to cause a computer to modify said image data to conform to said destination premultiplication state and set said current premultiplication state to said destination premultiplication state, if said current premultiplication state does not match said destination premultiplication state;

computer readable program code configured to cause a computer to obtain a first object;

computer readable program code configured to cause a computer to obtain a second object referenced by said first object, said second object comprising said at least one data array and at least one method that accesses said image data within said at least one data array; and computer readable program code configured to cause a computer to obtain a third object referenced by said first object, said third object comprising said state variable and said data coercion method.

6. The computer program product of claim 5 further comprising:

computer readable program code configured to cause a computer to send a second method invocation from said first object to said third object in response to receiving said first method invocation, said second method invocation comprising said destination premultiplication state and a reference to said second object, said second method invocation initiating said execution of said data coercion method.

7. The computer program product of claim 6 further comprising:

computer readable program code configured to cause a computer to invoke a first access method of said second object to get said image data from said at least one data array; and computer readable program code configured to cause a computer to invoke a second access method of said second object to put modified image data into said at least one data array.

8. A computer data signal embodied in a carrier wave and representing sequences of instructions which, when executed by a processor, cause said processor to handle alpha premultiplication of image data by performing the steps of:

storing a reference to at least one data array containing image data;

storing a state variable containing a current premultiplication state of said image data;

executing a data coercion method in response to a coerce message, said coerce message containing a destination premultiplication state, wherein said data coercion method comprises the steps of:

determining if said current premultiplication state matches said destination premultiplication state; and modifying said image data to conform to said destination premultiplication state and setting said current premultiplication state to said destination premultiplication state, if said current premultiplication state does not match said destination premultiplication state;

obtaining a first object;

obtaining a second object referenced by said first object, said second object comprising said at least one data array and at least one method that accesses said image data within said at least one data array; and obtaining a third object referenced by said first object, said third object comprising said state variable and said data coercion method.

9. The computer data signal of claim 8, wherein said sequences of instructions, when executed by said processor, cause said processor to perform the further step of:

sending a second method invocation from said first object to said third object in response to receiving said first method invocation, said second method invocation comprising said destination premultiplication state and a reference to said second object, said second method invocation initiating said execution of said data coercion method.

10. The computer data signal of claim 8, wherein said sequences of instructions, when executed by said processor, cause said processor to perform the further steps of:

invoking a first access method of said second object that gets said image data from said at least one data array; and invoking a second access method of said second object that puts modified image data into said at least one data array.

* * * * *